US008094864B2

(12) United States Patent
Inaba et al.

(10) Patent No.: US 8,094,864 B2
(45) Date of Patent: Jan. 10, 2012

(54) DIAPHRAGM UNIT AND SPEAKER USING THE SAME

(75) Inventors: Atsushi Inaba, Mie (JP); Hiroyuki Takewa, Osaka (JP)

(73) Assignee: Panasonic Corporation, Osaka (JP)

( * ) Notice: Subject to any disclaimer, the term of this patent is extended or adjusted under 35 U.S.C. 154(b) by 564 days.

(21) Appl. No.: 12/160,649

(22) PCT Filed: Apr. 9, 2007

(86) PCT No.: PCT/JP2007/057840

§ 371 (c)(1),
(2), (4) Date: Jul. 11, 2008

(87) PCT Pub. No.: WO2007/119709

PCT Pub. Date: Oct. 25, 2007

(65) Prior Publication Data

US 2010/0158306 A1 Jun. 24, 2010

(30) Foreign Application Priority Data

Apr. 10, 2006 (JP) ..... 2006-107372

(51) Int. Cl.
*H04R 1/00* (2006.01)

(52) U.S. Cl. ..... 381/398; 381/399; 381/403

(58) Field of Classification Search ..... 381/398, 381/399, 403

See application file for complete search history.

(56) References Cited

U.S. PATENT DOCUMENTS

2003/0112995 A1 6/2003 Frasl

FOREIGN PATENT DOCUMENTS

| | | |
|---|---|---|
| CN | 1502214 A | 6/2004 |
| JP | 61-75694 | 5/1986 |
| JP | 07-046690 | 2/1995 |
| JP | 10-191494 | 7/1998 |
| JP | 2005-167384 A | 6/2005 |

OTHER PUBLICATIONS

Japanese Office Action dated Mar. 8, 2011.
Translation of JP-07-046690-A which was previously submitted on Jul. 11, 2008.
Translation of JP-10-191494-A which was previously submitted on Jul. 11, 2008.
International Search Report Dated Jul. 10, 2007.

*Primary Examiner* — Richard A. Booth
(74) *Attorney, Agent, or Firm* — Pearne & Gordon LLP

(57) ABSTRACT

A diaphragm unit is arranged to be used in a loudspeaker including a frame. The diaphragm includes a diaphragm and an edge joined to an outer periphery of the diaphragm. The diaphragm extends in a longitudinal direction and has a first center line extends along the longitudinal direction. The edge has an outer periphery being arranged to join to the frame, and an inner periphery joined to the outer periphery of the diaphragm. The edge has a convex surface having substantially a semi-circular cross section. The convex surface of the edge has grooves provided therein. The grooves extend from the inner periphery of the edge to the outer periphery of the edge. The grooves have cross sections each having a U-shape or a V-shape, and are arranged symmetrically about the first center line of the diaphragm. This diaphragm unit provides an elongated loudspeaker reproducing bass sounds with small distortions.

11 Claims, 12 Drawing Sheets

DIAPHRAGM UNIT AND SPEAKER USING THE SAME

TECHNICAL FIELD

The present invention relates to a diaphragm unit and a loudspeaker using the diaphragm unit.

BACKGROUND ART

Television receivers have recently had a horizontally wide screen and demanded to have a small width and a small thickness as high-definition television and wide-screen television systems are available.

Loudspeakers installed in such a television receiver are often mounted to both sides of the screen, hence increasing the overall width of the television receiver. Such a television receiver generally includes a loudspeaker having an elongated shape, such as a rectangular or elliptical shape. The screen becomes wider, and the loudspeaker are accordingly demanded to have a smaller width. Television receivers have had their image quality increase and accordingly been demanded to have high quality of sound. As thin television receivers including plasma displays or liquid crystal displays have increased, loudspeakers are demanded to have small thickness.

FIG. 13A is a plan view of a conventional loudspeaker 900 disclosed in Patent Document 1. FIG. 13B is a cross sectional view of the loudspeaker 900 at line 13B-13B shown in FIG. 13A. The loudspeaker 900 includes a magnet 901, a plate 902, a yoke 903, a frame 904, a voice coil 905 having a cylindrical shape, and a diaphragm unit 906 having an oval shape. The diaphragm unit 906 has a dome portion 911 having a semicircular cross section provided at the center of the diaphragm unit at the inside of a voice coil 905. The diaphragm unit 906 includes a diaphragm 906B and an edge 912 connected to the outer periphery 906A of the diaphragm 906B. The voice coil drives diaphragm 906B so as to have the diaphragm vibrate to generate sounds. The voice coil 905 is fixed to the diaphragm unit 906. The outer periphery 906A of the diaphragm 906B has an oval shape having straight portions 906C and arcuate portions 906D. The edge 912 has a semicircular cross section. The edge 912 of the diaphragm unit 906 is joined to the frame 904 and supported with the frame 904. More particularly, the diaphragm unit 906 is supported by the frame 904 so that an end of the voice coil 905 is positioned in a magnetic gap provided between the plate 902 and the yoke 903.

Regarding the edge 912 having the semicircular cross section, a change of the curvature of portions of the edge 912 near the arcuate portions 906D of the outer periphery 906A of the diaphragm along a circumferential direction is larger than that of portions of the edge 912 near the straight portions 906C. The portions of the edge 912 near the arcuate portions 906D have stiffness larger than the portions of the edge 912 near the straight portions 906C. The edge 912 is not so elastic along the circumferential direction in response to the vibrating of the diaphragm 906B, and raises the lowest resonance frequency of the loudspeaker 900, accordingly preventing the loudspeaker from reproducing bass sounds. The edge 912 prevents the diaphragm unit 906 from responding to a large amplitude, thus producing distortions.

Patent Document 1: JP 10-191494A

SUMMARY OF THE INVENTION

A diaphragm unit is arranged to be used in a loudspeaker including a frame. The diaphragm includes a diaphragm and an edge joined to an outer periphery of the diaphragm. The diaphragm extends in a longitudinal direction and has a first center line extends along the longitudinal direction. The edge has an outer periphery being arranged to join to the frame, and an inner periphery joined to the outer periphery of the diaphragm. The edge has a convex surface having substantially a semi-circular cross section. The convex surface of the edge has grooves provided therein. The grooves extend from the inner periphery of the edge to the outer periphery of the edge. The grooves have cross sections each having a U-shape or a V-shape, and are arranged symmetrically about the first center line of the diaphragm.

This diaphragm unit provides an elongated loudspeaker reproducing bass sounds with small distortions.

REFERENCE NUMERALS

104 Frame
101A Longitudinal Direction of Diaphragm
101C Center Line of Diaphragm (First Center Line)

101 Diaphragm
103 Edge
114 Groove
115 Center Line of Groove
103C Convex Surface of Edge
101D Center Line of Diaphragm (Second Center Line)
101B Center of Diaphragm
109 Voice Coil
1001 Loudspeaker
1002 Diaphragm Unit

DETAIL DESCRIPTION OF THE PREFERRED EMBODIMENTS

Exemplary Embodiment 1

Figure 1:
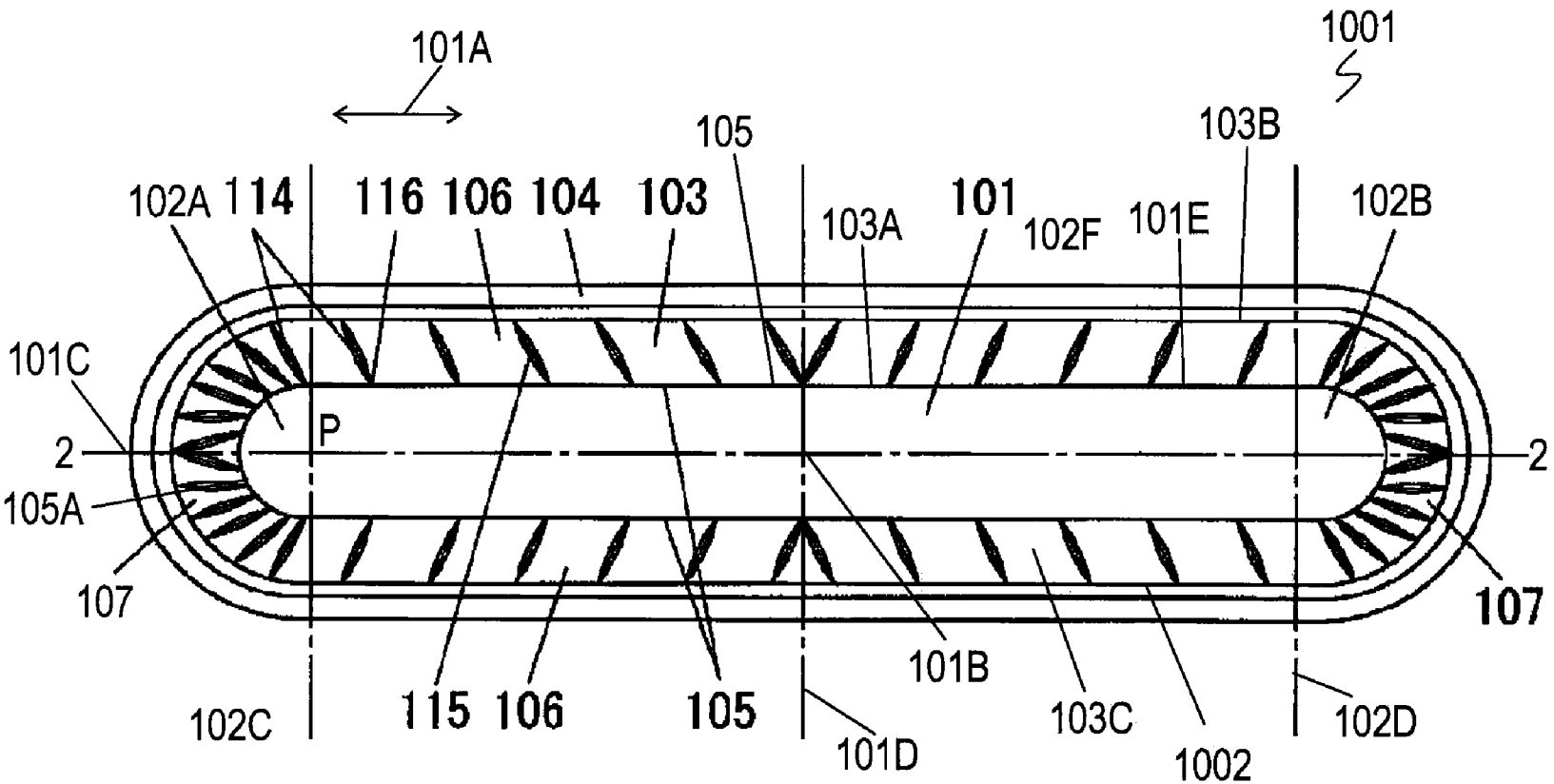
FIG. 1 is a plan view of a loudspeaker including a diaphragm unit according to Exemplary Embodiment 1 of the present invention.
Figure 2:
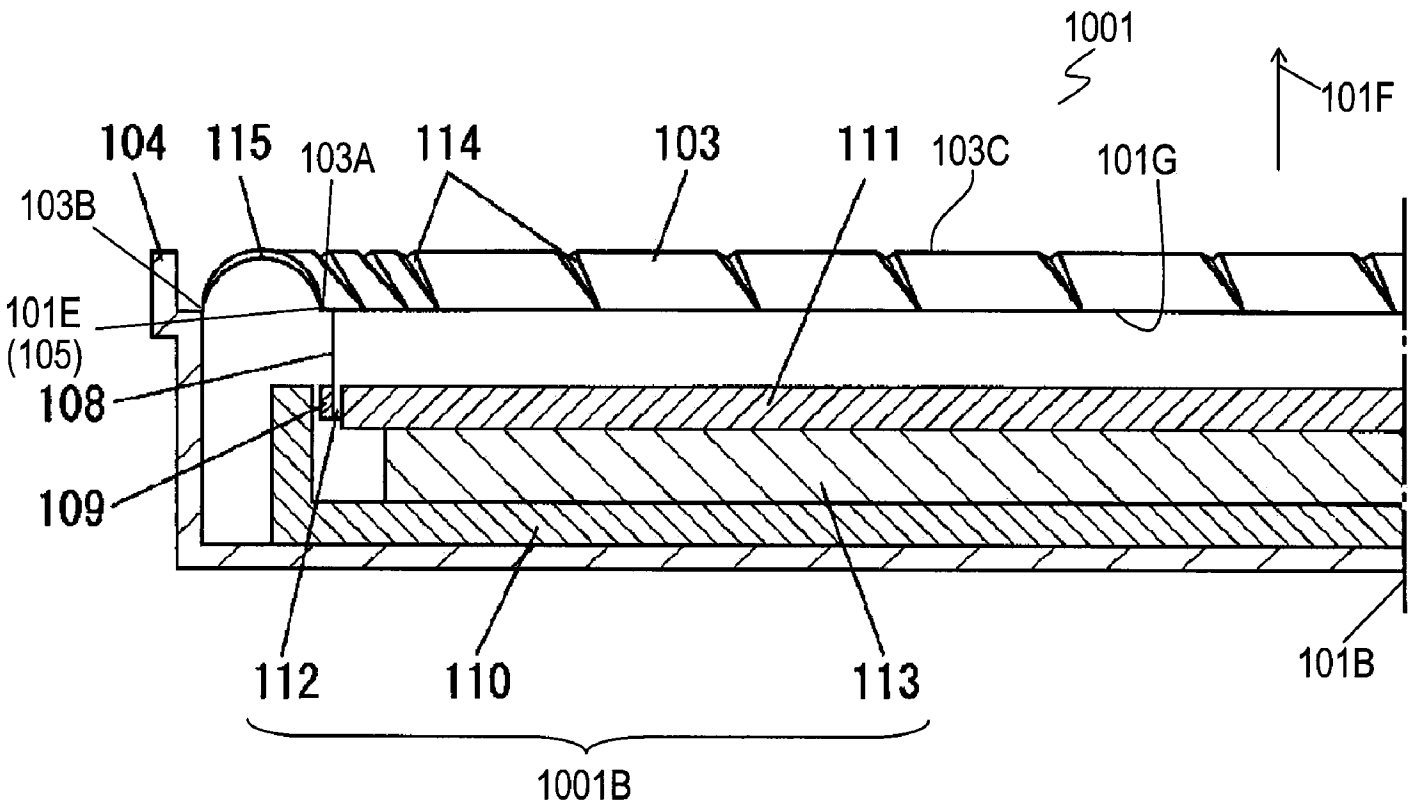
FIG. 2 is a cross sectional view of the loudspeaker at line 2-2 shown in FIG. 1.

FIG. 1 is a plan view of a loudspeaker 1001 according to Exemplary Embodiment 1 of the present invention. FIG. 2 is a cross sectional view of the loudspeaker at line 2-2 shown in FIG. 1.

The loudspeaker 1001 has an elongated diaphragm 101 extending in a longitudinal direction 101A. The diaphragm 101 has a center line 101C and a center line 101D which cross the center 101B of the diaphragm. The center line 101C extends along the longitudinal direction 101A. The center line 101D extends in perpendicular to the center line 101C. Both ends 102A, 102B along the longitudinal direction 101A of the diaphragm 101 have substantially semicircular shapes having center lines 102C and 102D, respectively. The outer periphery 102E of diaphragm 101 is joined to the inner periphery 103A of an edge 103 having substantially a semicircular cross section. The edge 103 has an outer periphery 103B fixed to a frame 104, and supports the diaphragm 101 to allow the diaphragm to vibrate along a vibrating direction 101F perpendicular to the center lines 101C and 101D. The diaphragm 101 and the edge 103 are formed by unitarily molding a thin sheet, such as a polyethylene naphthalate (PEN) sheet or a polyimide (PI) sheet, thus providing a diaphragm unit 1002. Alternatively, the diaphragm 101 and the edge 103 may be made of a thin sheet of metal, paper, cloth, or any other vibratile material. The diaphragm 101 and the edge 103 may be made of different materials and then bonded to each other to provide the diaphragm unit 1002. That is, the diaphragm unit 1002 is arranged to be used in the loudspeaker 1001 including the frame 104. The outer periphery 103B of the edge 103 is arranged to be joined to the frame 104. The center lines 101C, 101D, 102C, 102D are defined along a vibrating plane of the diaphragm 101.

The outer periphery 101E of the diaphragm 101 has an oval shape having the center line 101C extending along the longitudinal direction 101A, and has straight portions 105 having a linear shape and arcuate portions 105A having a semicircular shape. The edge 103 includes straight roll portions 106 connected to straight portions 105 of the outer periphery 101E of the diaphragm 101, and semi-annular roll portions 107 connected to arcuate portions 105A of the outer periphery 101E. The straight roll portion 106 has a semi-cylindrical shape having a semicircular cross section. The semi-annular roll portion 107 has a semi-annular shape having a semicircular cross section. The straight roll portions 106 are connected to the straight portions 105 of the diaphragm 101 extending along the longitudinal direction 101A. The semi-annular roll portions 107 are connected to the ends 102A and 102B. The semi-annular roll portions 107, upon being joined to each other, provides substantially a ring shape which is substantially identical to that of a roll edge used with a diaphragm of an ordinary loudspeaker having a conical shape. A voice coil bobbin 108 is fixed onto a lower surface 101G of the diaphragm 101. A voice coil 109 is wound on the voice coil bobbin 108, and arranged to have a driving current applied thereto. The voice coil 109 is suspended by the diaphragm 101 in a magnetic gap 112 which is defined between a yoke 110 and a plate 111. The plate 111 is fixed to an upper side of a magnet 113 while the yoke 110 is fixed to a lower surface of the magnet 113, thus constituting a magnetic circuit 1001B of internal magnet type. The edge 103 and the magnetic circuit 1001B are fixed to a frame 104, thus providing the loudspeaker 1001.

The edge 103 has plural grooves 114 provided in a convex surface 103C thereof. Each of the grooves 114 has a cross section having a U-shape or a V-shape. Each of the grooves 114 extends across the convex surface 103C from the inner periphery 103A to the outer periphery 103B of the edge 103. The depth of each of the grooves 114 increases gradually from the inner periphery 103A and becomes maximum at the top of the edge 103. Then, the depth of each of the grooves 114 decreases gradually from the top of the edge 103 to the outer periphery 103B. A center line 115 at the bottom of the groove 114 extends along the convex surface 103C of the edge 103, hence having substantially a semicircular shape and having a linear shape upon being projected on the same plane as the diaphragm 101.

Figure 3:
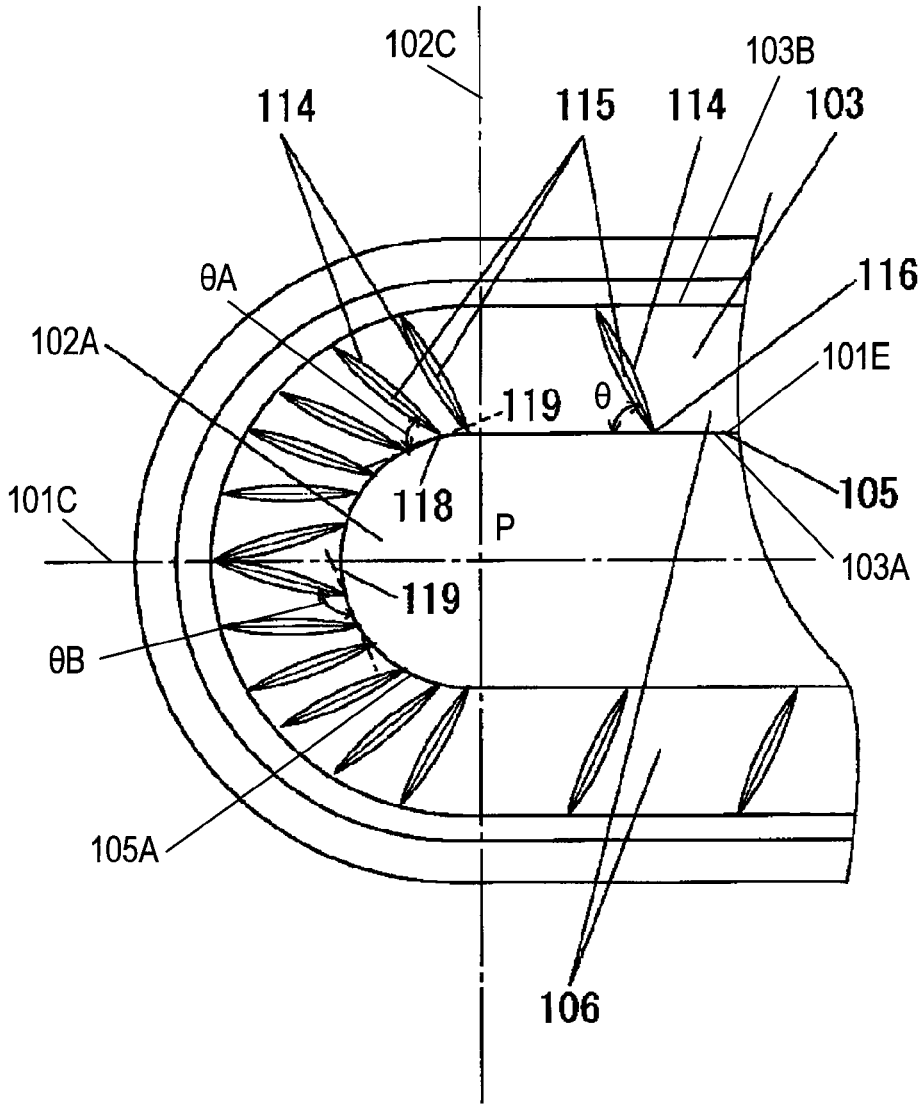
FIG. 3 is an enlarged plan view of the loudspeaker according to Embodiment 1.

The direction in which the groove 114 extends is determined by the following method. FIG. 3 is an enlarged plan view of the loudspeaker 1001. The center line 115 of the groove 114 provided at the straight roll portion 106 of the edge 103 intersects the outer periphery 101E of the diaphragm 103 (the inner periphery 103A of the edge 103) at a point 116. The groove 114 extends from the point 116 by an angle θ with respect to the outer periphery 101E (the inner periphery 103A of the edge 103). The angle θ is determined to make the length of the center line 115 of the groove 114 greater than the length along the convex surface 103C in a direction perpendicular to the inner periphery 103A of the edge 103.

Figure 4A:
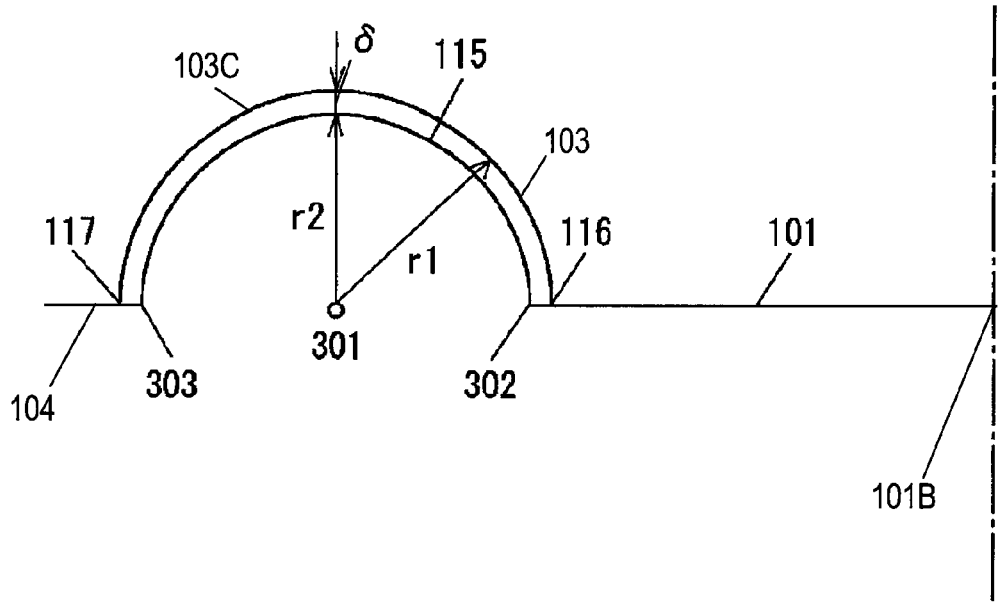
FIG. 4A is a cross sectional view of the diaphragm unit according to Embodiment 1.
Figure 4B:
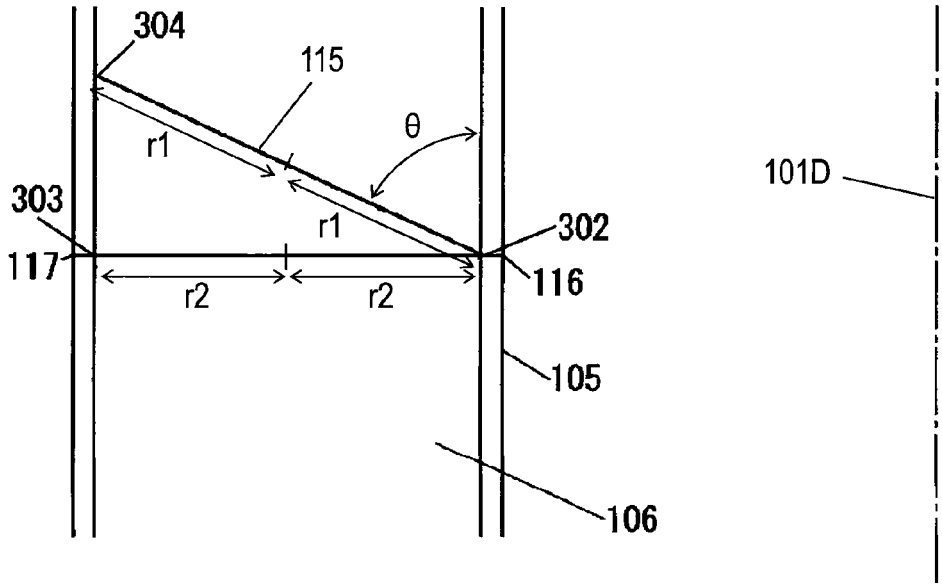
FIG. 4B is a plan view of the diaphragm unit according to Embodiment 1.

The method of determining the angle θ will be described in more detail below. FIGS. 4A and 4B are a cross sectional view and a plan view of the diaphragm unit 1002, respectively, for illustrating the relationship between the cross section of the edge 103 and the angle θ of the groove 114. The cross section of the straight roll portion 106 of the edge 103 has a semicircular shape having a radius r1. The center line 115 extending along the bottom of the edge 103 has a semicircular shape having radium r2. Although the depth of the groove 114 is smaller at both the inner periphery 103A and the outer periphery 103B than at the top of the edge 103, the center line 115 shown in FIG. 4A extends concentrically with the cross section of the straight roll portion 104 for easy explanation. In other words, the semicircular cross section of the straight roll portion 106 of the edge 103 and the semicircular shape of the center line 115 of the groove 114 have a center 301.

As shown in FIG. 4A, the edge 103 intersects the straight roll portion 10 of the diaphragm 101 at the point 116, and intersects the frame 104 at the point 117. The length of the straight line D between the points 116 and 117 is equal to the width of the edge 103. The center line 115 along the bottom of the groove 114 intersects the diaphragm 101 and the frame 104 at the point 302 and the point 303, respectively. A circumferential length Lr of the convex surface 103C of the edge 103 perpendicular to the center line 101C is expressed by the following formula.

$$Lr=\pi\times r1$$

When the groove 114 extends perpendicular to the straight portion 105 of the diaphragm 101, the circumferential length Ld of the center line 115 is expressed by the following formula.

$$Ld=\pi\times r2$$

Since the radius r1 is greater than the radius r2, the circumferential length Ld of the center line 115 of the groove 114 is shorter than the circumferential length Lr of the convex surface 103C of the edge 103. If the groove 114 extends perpendicularly to the straight line 105, the radius of the center line 115 becomes smaller, accordingly increasing the stiffness of the edge 103 at the groove 114. The circumferential length Ld is short, and decreases a maximum amplitude.

The center line 115 of the groove 114 is slanted by the angle θ with respect to the straight portion 105 to prevent the increase of the stiffness of the edge 103 at the groove 114 between the inner periphery 103A and the outer periphery 103B, hence providing the maximum amplitude with the same or larger level.

The depth δ of the groove 114 is determined to be 10% of the radius r1 of the cross section of the convex surface 103C of the edge 103.

$$r2=r1-\delta=0.9\times r1$$

As shown in FIG. 4B, the center line 115 of the groove 114 is slanted by the angle θ with respect to the straight portion 105. The angle θ is determined so that the distance along the center line 115 between the points 302 and 303 is longer than the distance between the points 116 and 117. The angle θ is calculated by the following formulae.

$$\begin{aligned}\theta &= \sin^{-1}(r2/r1)\\ &= \sin^{-1}((r2-\delta)/r1)\\ &= \sin^{-1}(0.9)\\ &= 64.16 \text{ (degrees)}\end{aligned}$$

Thus, the center line 115 of the groove 114 is slanted by the angle θ which is not greater than 64.16 degrees with respect to the straight portion 105, thereby allowing the circumferential length Ld along the center line 115 to be greater than the circumferential length Lr of the convex surface 103C of the edge 103.

The grooves 114 are provided in both the straight roll portions 106 and the semi-annular roll portions 107 of the edge 103. The intervals between the grooves 114 provided in the semi-annular roll portions 107 is smaller than the intervals between the grooves 114 provided in the straight roll portions 106. This arrangement decreases the stiffness to be increased due to the grooves 114, accordingly increasing the maximum amplitude.

The angle of the grooves 114 in the semi-annular roll portions 107, similar to that at the straight roll portions 106, is determined so that the circumferential length Ld along the center line 115 becomes greater than the circumferential length Lr of the convex surface 103C of the edge 103. As shown in FIG. 3, the center line 115 intersects the arcuate portion 105A of each end 102A (102B) at a point 118. The center line 115 of the groove 114 provided in the convex surface 103C, and is slanted by an angle θA smaller than the angle θ with respect to a tangent line 119 to the arcuate portion 105A at the point 118. The angle θA is smaller than the angle θ so that the center line 115 of the groove 114 provided in the straight roll portions 106 is shorter than the center line 115 of the groove 114 provided in the semi-annular portions 107, and that the circumferential length Ld is longer than the circumferential length Lr at the semi-annular portions 107. While the grooves 114 are slanted by the angle θ with respect to the center line 101C in the straight roll portions 106, the grooves 114 are slanted by the angle θA with respect to the tangent line 119 in the semi-annular roll portions 107 from the center line 102C to the center line 101C. The grooves 114 are arranged symmetrically about the center line 101C of the diaphragm 101. More specifically, the center lines 115 of the grooves 114 are slanted by the angle θA in one half of the semi-annular portion 107 divided by the center line 101C, and are slanted by the angle θB in the other half of the semi-annular portion 107 divided by the center line 101C.

$$\theta B=180-\theta A \text{ (degrees)}$$

An operation of the loudspeaker 1001 will be described below. When an alternating current is supplied to the voice coil 109, magnetic flux generated in the magnetic gap 112 which is perpendicular to the alternating current flowing in the voice coil 109 and to the vibrating direction 101F of the diaphragm 101 produces a driving force. The driving force causes the voice coil 109 to vibrate, and accordingly, causes the diaphragm 101 to vibrate along the vibrating direction 101F, thereby generating sounds.

An operation of the edge 103 in response to the vibrating of the diaphragm 101 will be described below. The edge 103 deforms to follow the vibration of the diaphragm 101. The deforming of the edge 103 is slightly different between the straight roll portions 106 and the semi-annular roll portions 107.

The straight roll portion 106 having the semi-cylindrical shape has small stiffness and has only its radius change. The edge 103 follows a large amplitude of the vibration of the diaphragm 101 according to the circumferential length Lr. The center line 115 of each groove 114 in the edge 103 is slanted by the angle θ with respect to the straight portions 105, thereby preventing both the increase of the stiffness and the declination of the amplitude. The grooves 114 separates straight roll portions 106 throughout their overall length along the longitudinal direction 101A, thereby raising a resonance frequency of the edge 103 which is determined by the length along the longitudinal direction 101A. The grooves 114 compensate the amount of shrinkage of the semi-annular roll portions 107 along the circumferential direction.

Figure 5:
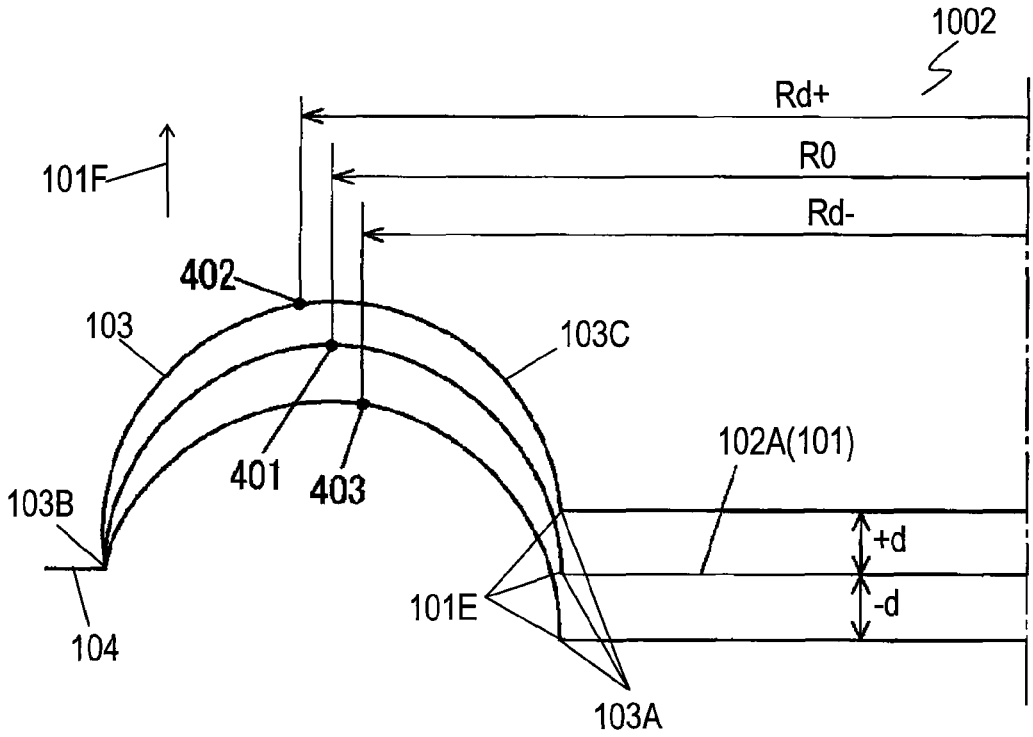
FIG. 5 is a cross sectional view of the diaphragm unit according to Embodiment 1.

In the case that the semi-annular roll portions 107 do not have the grooves 114 provided therein, the edge 103 would have the same problem as conventional loudspeakers. In this case, the edge 103 would not shrink along the circumferential direction and would have large stiffness, accordingly having the linearity of the amplitude of the vibration deteriorate. FIG. 5 is a cross sectional view of the diaphragm unit 1002 at line 2-2 shown in FIG. 1 while the diaphragm 101 vibrates. FIG. 5 illustrates the shape of the edge 103 when the diaphragm 101 is shifted by a displacement +d and a displacement −d along the vibrating direction 101F. The radius which extends from the center P of the semi-circular end 102A of the diaphragm 101 to the top 401 of the convex surface of the semi-annular roll portion 107 is R0 when the diaphragm 101 does not vibrated. When the diaphragm 101 is shifted by the displacement +d, the top 401 moves towards the outer periphery 103B of the edge 103 and reaches a point 402. Then, the radius extending from the center P of the semi-circular end 102A of the diaphragm 101 to the point 402 becomes Rd+. In contrast, when the diaphragm 101 is shifted by the displacement −d, the top 401 moves towards the inner periphery 103A of the edge 103 and reaches a point 403. Then, the radius extending from the center P of the semi-circular end 102A of the diaphragm 101 to the point 403 becomes Rd−. The radiuses Rd+, R0, and Rd− satisfy the following condition.

$$Rd+>R0>Rd-$$

The circumferential lengths Lr1, Lr2, and Lr3 of the semi-annular roll portion 107 corresponding to Rd+, R0, and Rd−, respectively, are expressed by the following formulae.

$$Lr1=\pi Rd+$$

$$Lr2=\Pi RO$$

$$Lr3=\Pi Rd-$$

The circumferential lengths Lr1, Lr2, and Lr3 satisfy the following condition.

$$Lr1>Lr2>Lr3$$

The circumferential length along the convex surface of the semi-annular roll portion 107 of the edge 103 IS required to change in response to the vibration of the diaphragm 101 in order to have the semi-annular roll portion 107 have the semi-circular cross section. However, the edge 103 may be often made of polymer material, such as PEN or PI, or fabric material, and can hardly shrink. The edge 103 does not maintain the semi-circular cross section of the semi-annular roll portion 107, and have large stiffness, accordingly being prevented from following large amplitude of the vibration of the diaphragm 101. According to Embodiment 1, the grooves 114 are provided in the semi-annular roll portions 107 and are slanted by the angle θA. The widths of the grooves 114 are widened and narrowed to allow the circumferential length of the semi-annular roll portion 107 to change, thus preventing the loudspeaker 1001 from having its lowest resonance frequency rise.

According to Embodiment 1, the grooves 114 are arranged symmetrically about the center line 101C of the diaphragm 101 along the longitudinal direction 101A, allowing the straight roll portions 106 and the diaphragm 101 to shrink evenly. This prevents the vibration of the diaphragm 101 from being biased, thus preventing the rolling of the diaphragm.

Figure 6:
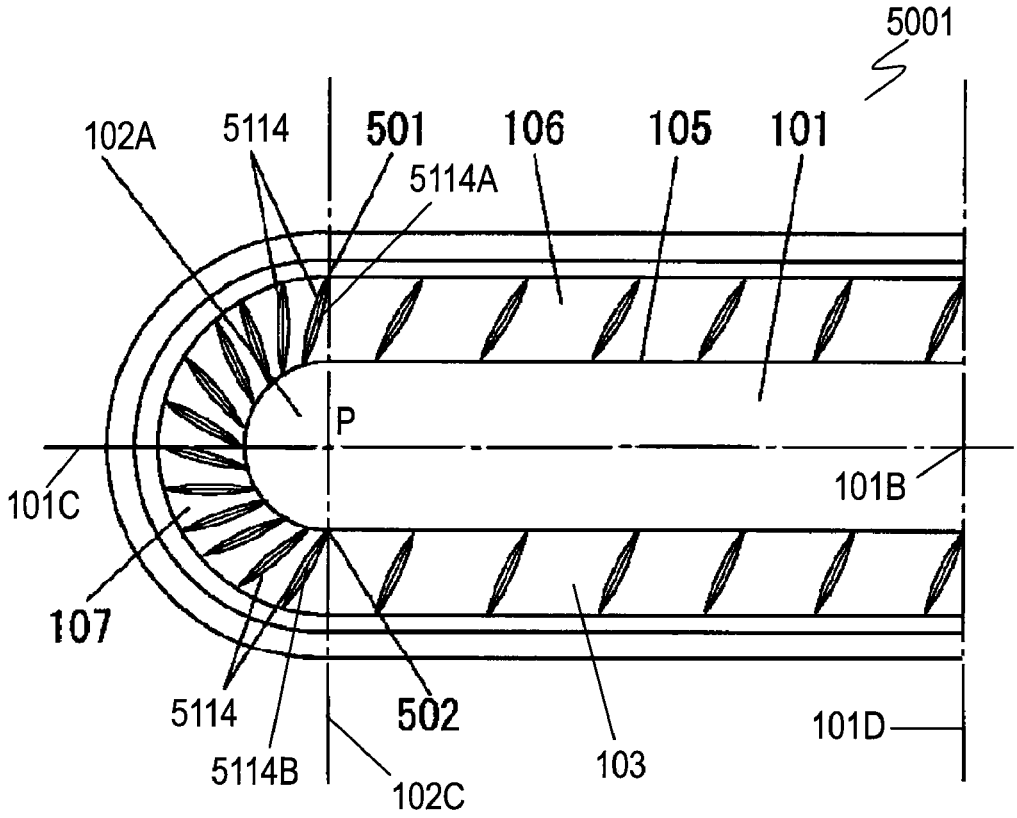
FIG. 6 is a plan view of a comparative example of the diaphragm unit.

FIG. 6 is a plan view of a comparative example of a diaphragm unit 5001. In FIG. 6, components identical to those in FIG. 1 are denoted by the same reference numerals, and their description will be omitted. The diaphragm unit 5001 has grooves 5114 which are slanted in the same direction throughout the straight roll portions 106 and the semi-annular roll portions 107, instead of the grooves 114 of the diaphragm unit 1002 shown in FIG. 1. In other words, the grooves 5114 are not arranged symmetrically about the center line 101C. At the center line 102C connecting the straight roll portions 106 to the semi-annular roll portion 107, grooves 5114A and 5114B out of the grooves 5114 are connected to the outer periphery 501 and the inner periphery 502 of the edge 103, respectively. This structure causes the semi-annular roll portion 107 which is shrinkable to be different in shrinkage from the straight roll portions 106 which are not shrinkable, distributing the amplitude of the vibration unevenly. The shrinkage is insufficient at the groove 5114A connected to the outer periphery 501 while the shrinkage at the groove 5114B connected to the inner periphery 502 is excessive. This changes stiffness at the both grooves and makes the amounts of the deforming at the grooves different from each other. This difference of the amounts of the deforming produces rolling effect in which the diaphragm vibrates in inclined directions.

In the diaphragm unit 1002 according to Embodiment 1, the grooves 114 are arranged symmetrically about the center line 101C, hence having the amplitude of the vibration distributing uniformly along the center line 102C. The edge 103 of the diaphragm unit 1002 prevents the rolling effect and reduces its stiffness, thereby having preferable linearity.

Figure 7A:
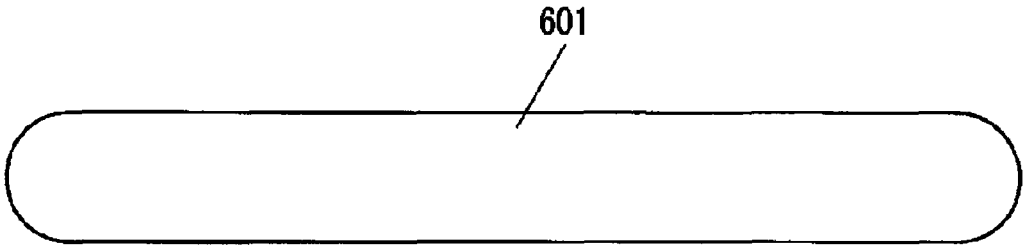
FIG. 7A is a plan view of another diaphragm unit according to Embodiment 1.
Figure 7B:
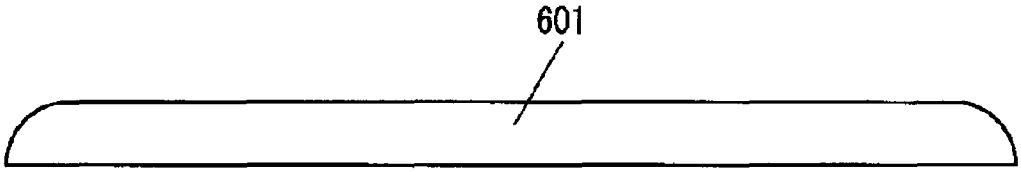
FIG. 7B is a side view of the diaphragm unit shown in FIG. 7A.
Figure 8A:
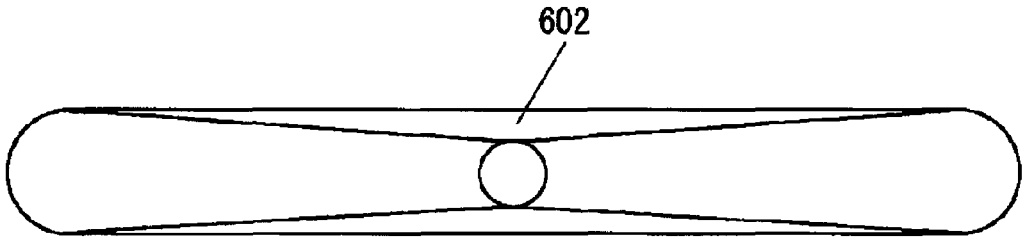
FIG. 8A is a plan view of a further diaphragm unit according to Embodiment 1.
Figure 8B:
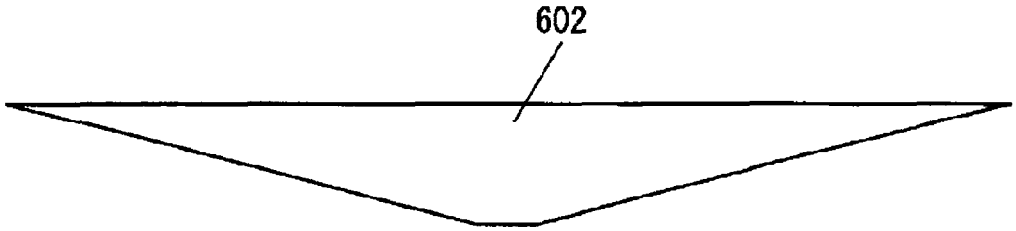
FIG. 8B is a side view of the diaphragm unit shown in FIG. 8A.

The diaphragm 101 of the diaphragm unit 1002 has the oval shape including the semi-circular ends 102A and 102B. The diaphragm according to Embodiment 1 may have any shape, such as a rectangular shape, other than the oval shape extending along a longitudinal direction. FIGS. 7A and 7B are a plan view and a side view of another diaphragm 601 according to Embodiment 1, respectively. The diaphragm 601 has a dome shape. The diaphragm unit 1002 includes the diaphragm 601 instead of the diaphragm 101, providing the same effects. FIGS. 8A and 8B are a plan view and a side view of a further diaphragm 602 according to Embodiment 1. The diaphragm 602 has a conical shape. The diaphragm unit 1002 includes the diaphragm 602 instead of the diaphragm 101, providing the same effects.

Exemplary Embodiment 2

Figure 9:
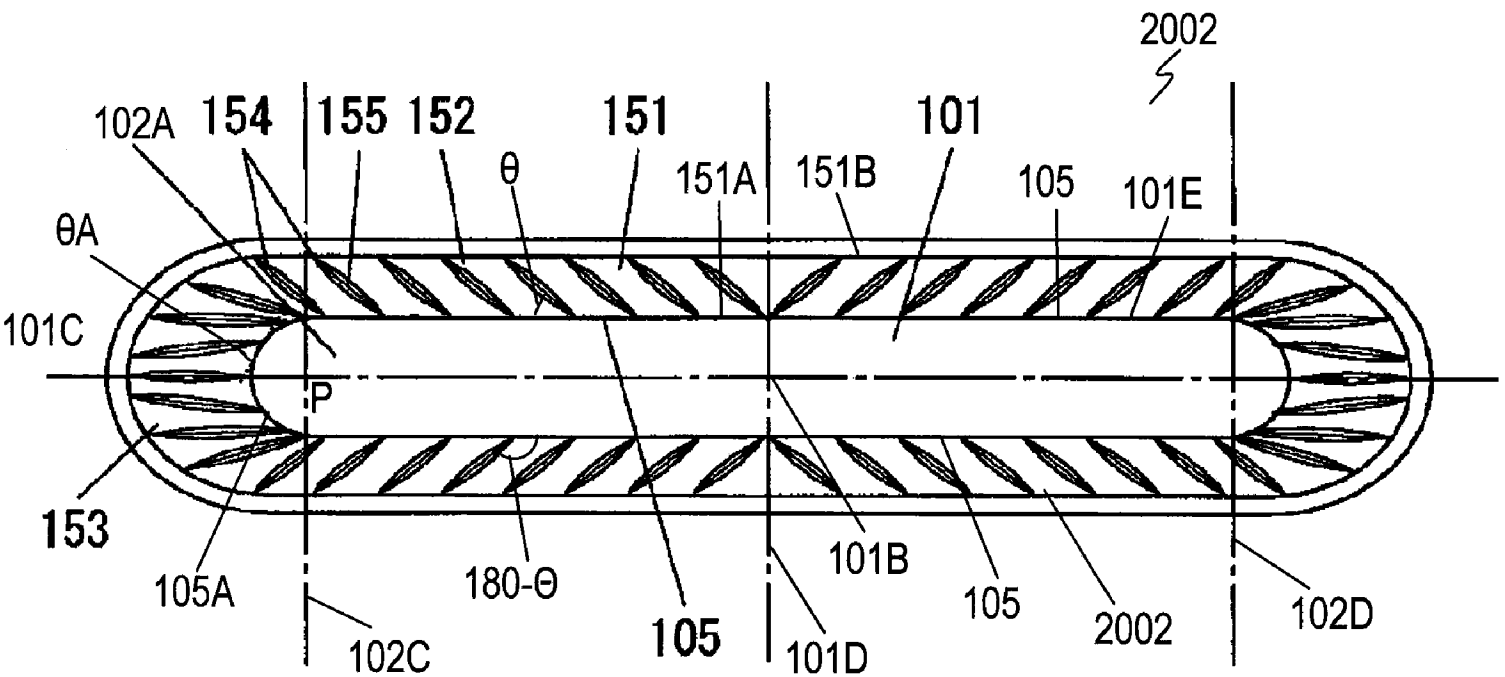
FIG. 9 is a plan view of a diaphragm unit according to Exemplary Embodiment 2 of the invention.

FIG. 9 is a plan view of a diaphragm unit 2002 of a loudspeaker 2001 according to Exemplary Embodiment 2 of the present invention. The diaphragm unit 2002 includes a diaphragm 101 and an edge 151. In FIG. 9, components identical to those in FIG. 1 are denoted by the same reference numerals, and their description will be omitted.

The diaphragm unit 2002 includes the edge 151 having a shape substantially identical to that of the edge 103 instead of the edge 103 of the diaphragm unit 1002 shown in FIG. 1. An inner periphery 151A of the edge 151 is joined to the outer periphery 101E of the diaphragm 101. An outer periphery 151B of the edge is joined to the frame. The edge 151 supports the diaphragm 101 to allow the diaphragm to vibrate along a vibrating direction.

The edge 151 includes, similarly to the edge 103 shown in FIG. 1, straight roll portions 152 and semi-annular roll portions 107. The straight roll portions 152 have semi-cylindrical shapes and are joined to the straight portions 105 of the outer periphery 101E of the diaphragm 101. The semi-annular roll portions 107 have semi-annular shapes and are joined to the arcuate portions 105A of the outer periphery 101E of the diaphragm 101. The straight roll portions 152 are provided at respective sides of the diaphragm 101 about the center line 101C. The semi-annular roll portions 153 are provided at both ends 102A and 102B of the diaphragm 101. The width of the semi-annular roll portion 153 increases gradually from the center line 102 at which the semi-annular roll portion 153 is connected to the straight roll portions 152, and becomes largest at the center line 101C.

Grooves 154 each having a cross section having a U-shape or a V-shape are provided in a convex surface 151C of the edge 151, similarly to the grooves 114 in the edge 103. The grooves 154 are provided along the convex surface 151C of the edge 151 from the inner periphery 151A to the outer periphery 151B. The depth of each groove 154 increases gradually from the inner periphery 151A and becomes maximum at the top of the convex surface 151C of the edge 151. Then, the depth of each groove 154 decreases gradually from the top of the convex surface 151C to the outer periphery 151B. Center line 155 at the bottom of the groove 154 extends along the convex surface 151C of the edge 151. Center line 155 has substantially a semi-circular shape and has a linear shape upon projected on the same plane as the diaphragm 101. The grooves 114 are inclined by predetermined angles from the inner periphery 151A at which the grooves 114 is connected to the diaphragm 101. Similar to Embodiment 1, the angle is determined so that the length of the center line 155 of each groove 154 is greater than the length along the convex surface 151C of the edge 151.

The semi-annular roll portion 153 has grooves 154 provided therein. The grooves 154 are slanted by predetermined angles with respect to tangent lines to the inner periphery 151A at points where the grooves 154 intersect the inner periphery 151A. The angles are equal to the angle of the grooves 154 in the straight roll portion 152. The grooves 154 are arranged symmetrically about the center line 101C of the diaphragm 101.

An operation of the loudspeaker 2001 will be described below. The operation is substantially identical to that of the loudspeaker 1001 according to Embodiment 1. In the loudspeaker 2001 according to Embodiment 2, the semi-annular roll portions 153 have width larger than those of the straight roll portions 152, accordingly having small stiffness. Accordingly, the displacement of the top of the convex surface 151C of the edge 151 becomes smaller than that of the loudspeaker 1001 during the vibration of the diaphragm 101. As the result, the edge 151 of the diaphragm unit 2002 may not be required to expand along the circumferential direction of the edge, hence following large amplitude of the vibration of the diaphragm 101.

In the diaphragm unit 2002 according to Embodiment 2, the diaphragm 101 has an oval shape. The diaphragm 101 according to Embodiment 2, similarly to Embodiment 1, may have any other shape, such as a rectangular shape, having a longitudinal direction. The diaphragm unit 2002 may include, instead of the diaphragm 101, the diaphragm 601 shown in FIGS. 7A and 7B or the diaphragm 602 shown in FIGS. 8A and 8B, providing the same effects.

Exemplary Embodiment 3

Figure 10:
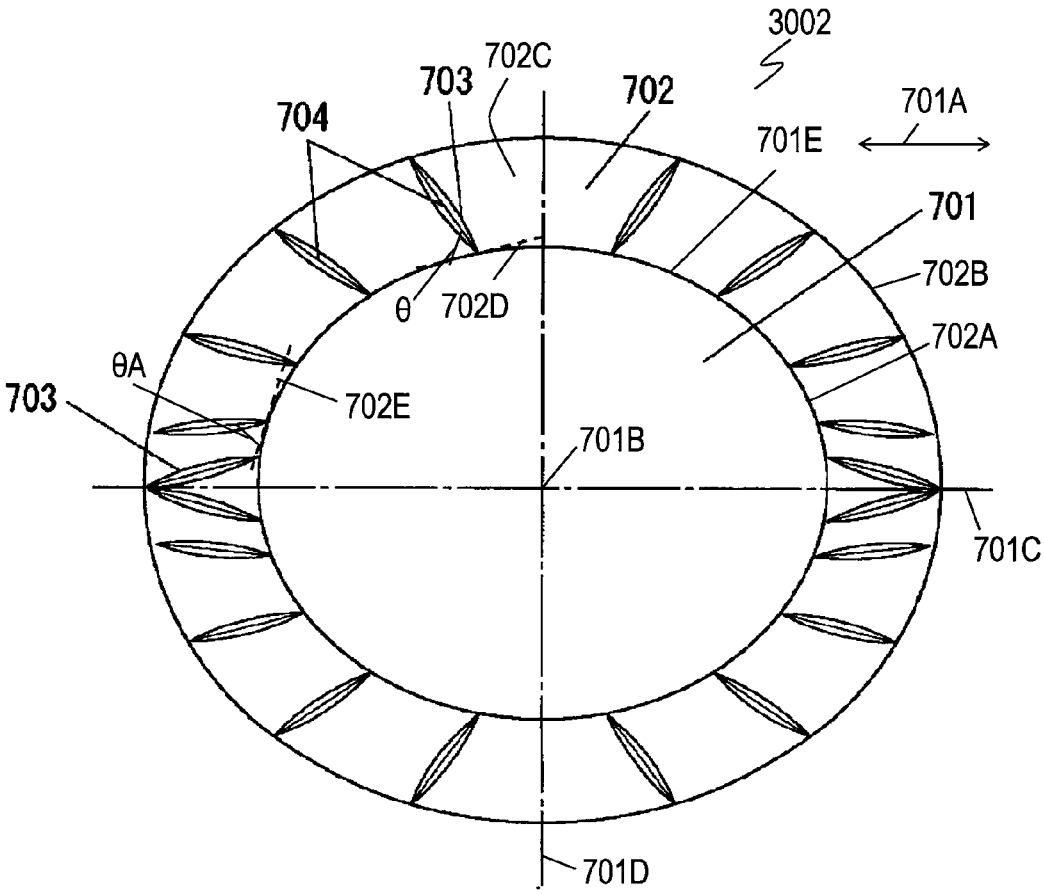
FIG. 10 is a plan view of a diaphragm unit according to Exemplary Embodiment 3 of the invention.

FIG. 10 is a plan view of a diaphragm unit 3002 of a loudspeaker according to Exemplary Embodiment 3 of the present invention. The diaphragm unit 3002 includes a diaphragm 701 having an elliptical shape. The diaphragm 701 extends along a longitudinal direction 701A and has a center line 701C parallel to the longitudinal direction 701A and a center line 701D extended from a center 701B perpendicularly to the center line 701C. More particularly, the elliptical shape of the diaphragm 701 has a major axis along the center line 701C and a minor axis along the center line 701D. An outer periphery 701E of the diaphragm 701 is joined to an edge 702. The edge 702 has substantially a semi-circular shape in the cross section. The edge 702 is joined at its inner periphery 702A to the outer periphery 701E of the diaphragm 701. Similar to the loudspeaker 1001 of Embodiment 1 shown in FIGS. 1 and 2, the edge 702 is fixedly mounted at its outer periphery 702B to the frame of the loudspeaker so as to support the diaphragm 701 for vibrating along the vibrating direction.

A convex surface 702C of the edge 702 has grooves 703 provided therein. Each groove 703 has a cross section having a U-shape or a V-shape. The grooves 703 are provided along the convex surface 702C from the inner periphery 702A to the outer periphery 702B of the edge 702. The depth of each groove 703 increases gradually from the inner periphery 702A and becomes maximum at the top of the convex surface 702C. The depth of the groove 703 decreases gradually from the top of the convex surface 702C to the outer periphery 702B. A center line 704 at the bottom of each groove 703 is arranged along the convex surface 702C of the edge 702. The center line 704 has substantially a semi-circular shape, and has a linear shape upon being projected on the same plane as the diaphragm 701. The grooves 703 are inclined by an angle θ with respect to a tangent line 702D to the inner periphery 702A. Similar to Embodiment 1, the angle θ is determined so that the length of the center line 704 of the groove 703 is greater than the length of the convex surface 702C of the edge 702.

The intervals between grooves 703 decreases gradually from the center line 701D, the minor axis of the diaphragm 701, to the center line 701C, the major axis, of the diaphragm 701. In other words, the grooves 703 are provided more densely near the center line 701C, the major axis, than near of the center line 701D, the minor axis. The grooves 703 are arranged symmetrically about the center line 701C. In the case that the grooves 703 are slanted by the angle θ, the grooves 703 arranged symmetrically about the center line 701C are slanted by an angle (180−θ) (degrees). The angle θA between the center line 704 of the groove 703 and a tangent line 702E to the inner periphery close to the center line 701C, the major axis, is greater than the angle θ between the center line 704 of the groove 703 and the tangent line 702D close to the center line 701D, the minor axis.

An operation of the loudspeaker according to Embodiment 3 will be described below. The operation is substantially identical to that of the loudspeaker 1001 according to Embodiment 1. The diaphragm 701 has the elliptical shape and causes the expansion and shrinkage of the edge 702 along its circumferential direction required for the amplitude of vibration to change locally. More specifically, the distance from the center 701B is smaller along the center line 701D, the minor axis, than along the center line 701C, the major axis, the same amplitude of the vibration makes a smaller amount of the change of the length along the circumferential direction near the center line 701C than near the center line 702C.

Figure 11A:
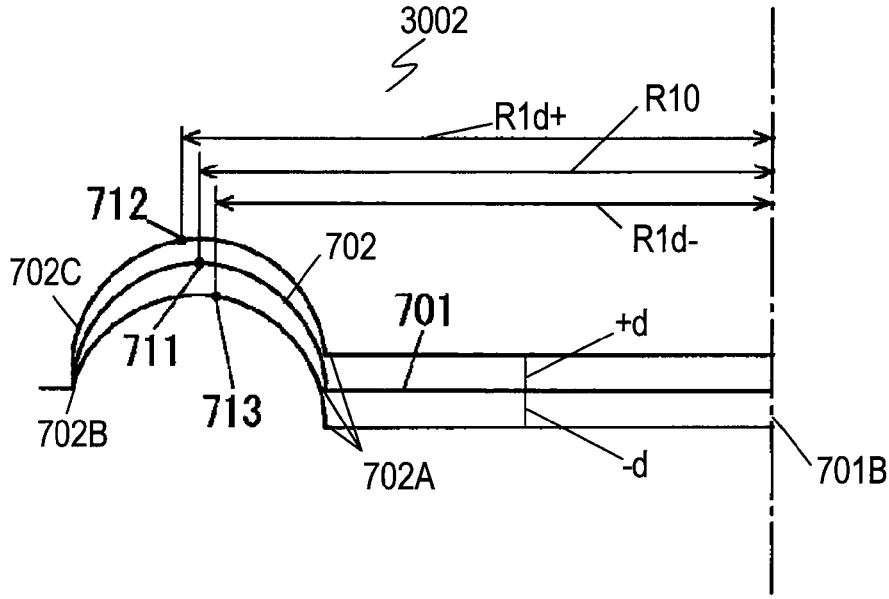
FIG. 11A is a cross sectional view of the diaphragm unit according to Embodiment 3.
Figure 11B:
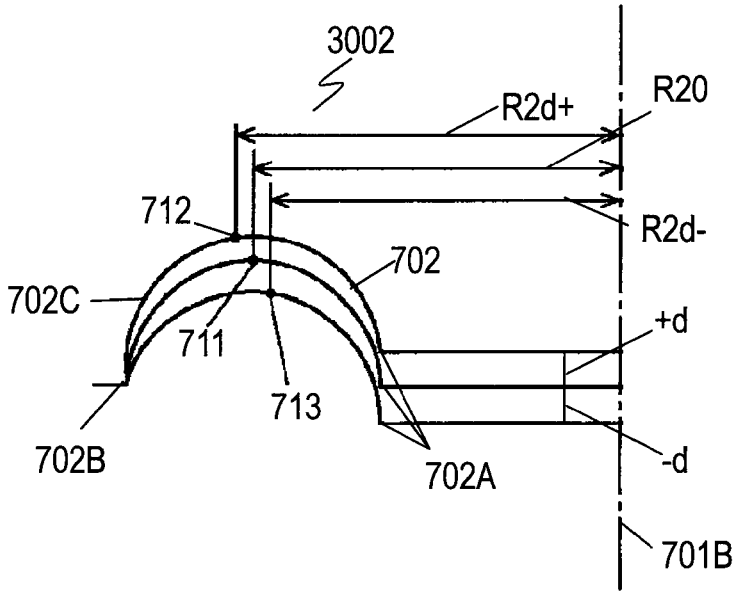
FIG. 11B is a cross sectional view of the diaphragm unit according to Embodiment 3.

FIGS. 11A and 11B are cross sectional views of the diaphragm unit 3002 at the center lines 701C and 701D of FIG. 10, respectively. FIGS. 11A and 11B illustrate the movement of the top 711 of the convex surface 702C of the edge 703 along the center lines 701C and 701D, respectively. FIGS. 11A and 11B show the convex surface 702C deforming when the diaphragm 701 moves by displacements +d and −d along the vibrating direction 701F. When the diaphragm 701 remains at a neutral position, the distance along the center line 701D between the center 701B of the diaphragm 701 and a top 712 at the convex surface 702C of the edge 702 is R20, and the distance along the center line 701C between the center 701B of the diaphragm 701 and the top 712 at the convex surface 702C of the edge 702 is R10. When the diaphragm 701 moves by the displacement +d along the vibrating direction 701F, the top 711 moves towards the outer periphery 702B of the edge 702, and reaches a point 712. Then, the distance along the center line 701D between the center 701B of the diaphragm 701 and the point 712 becomes R2*d*+ while the distance along the center line 701C between the center 701B of the diaphragm 701 and the top 712 becomes R1*d*+. When the diaphragm 701 moves by the displacement −d along the vibrating direction 701F, the top 711 moves towards the inner periphery 702A of the edge 702, and reaches a point 713. Then, the distance along the center line 701D between the center 701B of the diaphragm 701 and the point 713 becomes R2*d*− while the distance along the center line 701C between the center 701B of the diaphragm 701 and the top 713 becomes R1*d*−. The distances R2*d*+, R2, R2*d*−, R1*d*+, R1, and R1*d*− satisfy the following condition.

$$R2d+>R2>R2d-$$

$$R1d+>R1>R1d-$$

$R1d+>R2d+$ $R1d->R2d-$

This condition shows that the length of the edge 702 along the circumferential direction is required to change according to the vibration, the change along the major axis is greater than along the minor axis. The difference of the change of the length along the circumferential direction is offset by decreasing the number of the grooves 703 near the center line 701D, the minor axis, and increasing the number of the grooves 703 bear the center line 701C, the major axis. This arrangement prevents the edge 702 having the elliptical, annular shape from having large stiffness, accordingly allowing the edge 702 to vibrate in response to the vibration of large amplitudes of the diaphragm 701.

In the diaphragm unit 3002 according to Embodiment 3, the diaphragm 701 is made of a flat elliptical sheet. The diaphragm unit 3002 may include the diaphragm 601 shown in FIGS. 7A and 7B or the diaphragm 602 shown in FIGS. 8A and 8B instead of the diaphragm 701, providing the same effects.

Figure 12:
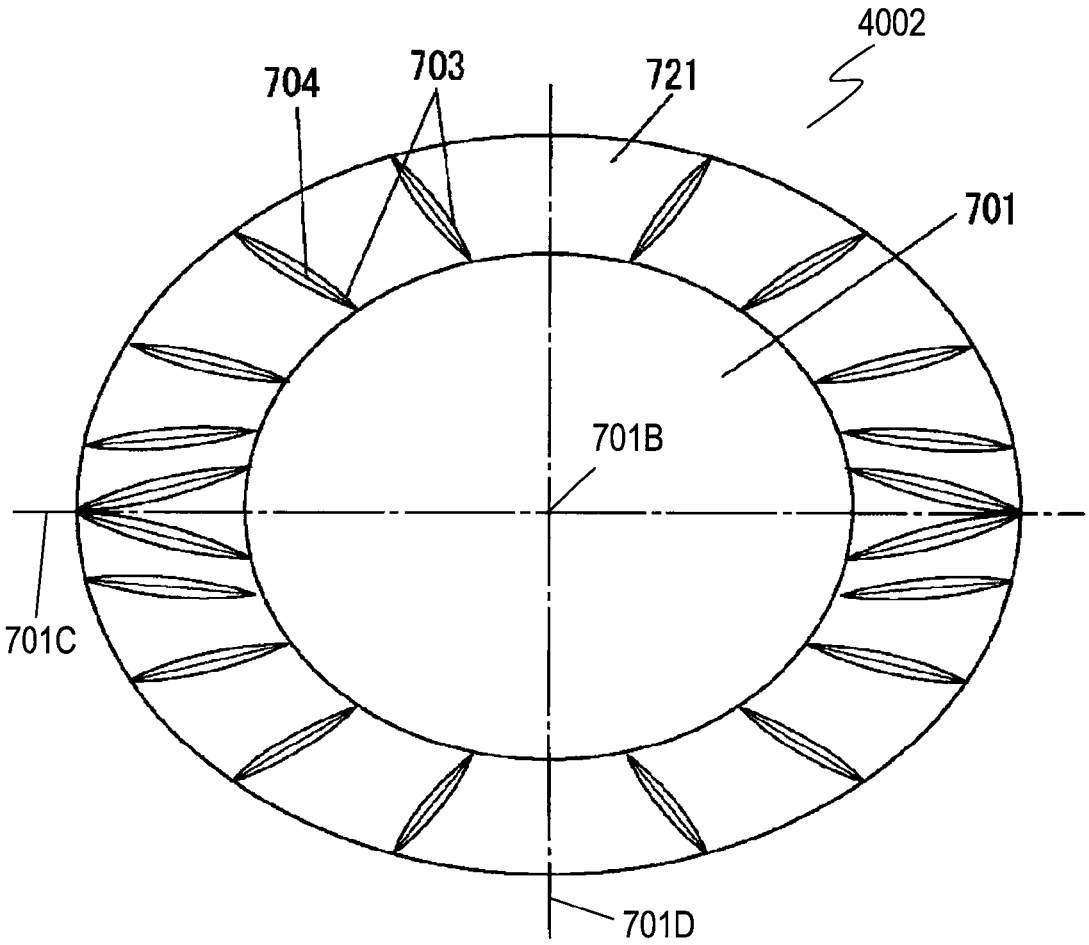
FIG. 12 is a plan view of another diaphragm unit according to Embodiment 3.
Figure 13A:
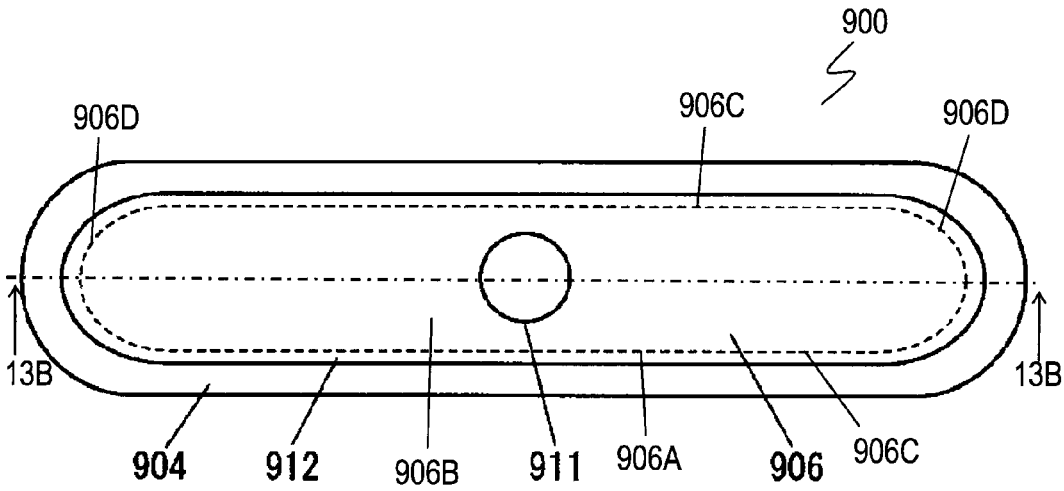
FIG. 13A is a plan view of a conventional loudspeaker.
Figure 13B:
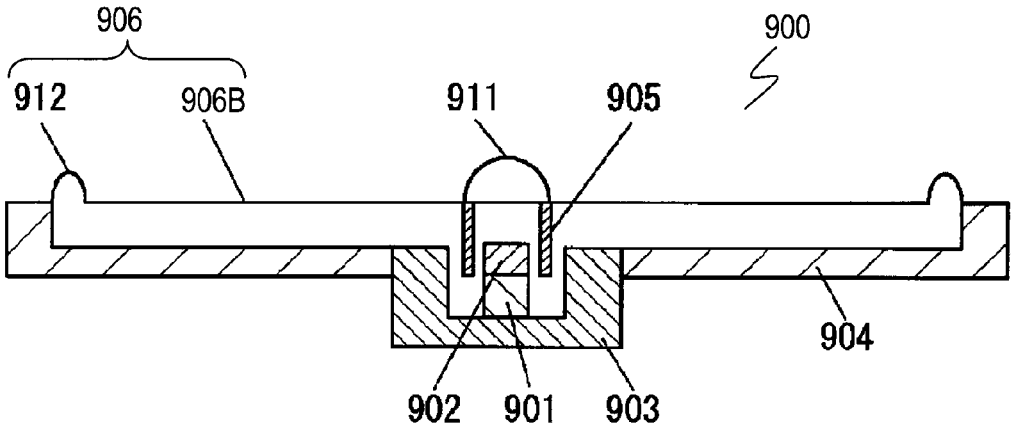
FIG. 13B is a cross sectional view of the conventional loudspeaker at line 13B-13B shown in FIG. 13A.

FIG. 12 is a plan view of another diaphragm unit 4002 of a loudspeaker according to this embodiment. In FIG. 12, components identical to those shown in FIG. 10 are denoted by the same reference numerals, and their description will be omitted. The diaphragm unit 4002 includes a diaphragm 701 and an edge 721 joined to an outer periphery 701E of the diaphragm 701. The width of the edge 721 along the center line 701C, the major axis, is larger than that along the center line 701D, the minor axis. This structure provides the diaphragm unit 4002 with the same effects as the diaphragm unit 2002 according to Embodiment 2 shown in FIG. 9.

INDUSTRIAL APPLICABILITY

A loud speaker according to the present invention has a slim shape a large length-to-width ratio, thus allowing electronic appliances to have a small and slim size.

The invention claimed is:

1. A diaphragm unit for arranged to be used in a loudspeaker including a frame, said diaphragm comprising:

a diaphragm extending in a longitudinal direction and having a first center line extends along the longitudinal direction; and an edge having an outer periphery and an inner periphery, the outer periphery being arranged to join to the frame, the inner periphery being joined to an outer periphery of the diaphragm, the edge having a convex surface having substantially a semi-circular cross section, wherein the convex surface of the edge have a plurality of grooves provided therein, the plurality of grooves extending from the inner periphery of the edge to the outer periphery of the edge, the plurality of grooves have cross sections each of which has a U-shape or a V-shape and has a center line extending along a bottom of each of the plurality of grooves, the plurality of grooves being arranged symmetrically about the first center line of the diaphragm, and a length of the center line of each of the grooves is greater than a circumferential length along the convex surface of the edge in a direction perpendicular to the inner periphery of the edge.

2. The diaphragm unit according to claim 1, wherein the diaphragm has an oval shape having the first center line extending along the longitudinal direction.

3. The diaphragm unit according to claim 1, wherein the diaphragm has an elliptical shape having the first center line extends along the longitudinal direction.

4. The diaphragm unit according to claim 1, wherein the diaphragm has a second center line extending perpendicularly to the first center line and crossing a center of the diaphragm, and a width of the edge along the first center line is larger than a width of the edge along the second center line.

5. The diaphragm unit according to claim 1, wherein the diaphragm has a second center line extending perpendicularly to the first center line and crossing a center of the diaphragm, and intervals between the plurality of grooves decreases from the second center line to the first center line.

6. A loudspeaker comprising:

a frame;

a diaphragm extending in a longitudinal direction and having a first center line extends along the longitudinal direction; and an edge having an outer periphery and an inner periphery, the outer periphery being arranged to join to the frame, the inner periphery being joined to an outer periphery of the diaphragm, the edge having a convex surface having substantially a semi-circular cross section, wherein the convex surface of the edge have a plurality of grooves provided therein, the plurality of grooves extending from the inner periphery of the edge to the outer periphery of the edge, and the plurality of grooves have cross sections each of which has a U-shape or a V-shape and has a center line extending along a bottom of each of the plurality of grooves, the plurality of grooves being arranged symmetrically about the first center line of the diaphragm, and a length of the center line of each of the grooves is greater than a circumferential length along the convex surface of the edge in a direction perpendicular to the inner periphery of the edge.

7. The diaphragm unit according to claim 2, wherein the outer periphery of the diaphragm has two straight portions having a linear shape and two arcuate portions having a semicircular shape, the edge includes two straight roll portions and two semi-annular roll portions, the two straight roll portions having a linear shape and being connected to the two straight portions of the diaphragm, respectively, the two semi-annular roll portions having a semi-circular shape and being connected to the two arcuate portions of the outer periphery of the diaphragm, respectively, the center line of the each of the plurality of grooves is slanted by a first angle with respect to a tangent line to the inner periphery of the edge at a point where the centerline and the inner periphery intersects within the two semi-annular roll portions, the center line of the each of the plurality of grooves is slanted by a second angle with respect to the inner periphery of the edge within the two straight roll portions, and the first angle is smaller than the second angle.

8. The diaphragm unit according to claim 2, wherein the outer periphery of the diaphragm has two straight portions having a linear shape and two arcuate portions having a semicircular shape, the edge includes two straight roll portions and two semi-annular roll portions, the two straight roll portions having a linear shape and being connected to the two straight portions of the diaphragm, respectively, the two semi-annular roll portions having a semi-circular shape and being connected to the two arcuate portions of the outer periphery of the diaphragm, respectively, intervals between the plurality of grooves within the two semi-annular roll portions of the edge are smaller than intervals between the plurality of grooves within the two straight roll portions of the edge.

9. The loudspeaker according to claim 6, wherein the diaphragm has an oval shape having the first center line extending along the longitudinal direction.

10. The loudspeaker according to claim 9, wherein the outer periphery of the diaphragm has two straight portions having a linear shape and two arcuate portions having a semicircular shape, the edge includes two straight roll portions and two semi-annular roll portions, the two straight roll portions having a linear shape and being connected to the two straight portions of the diaphragm, respectively, the two semi-annular roll portions having a semi-circular shape and being connected to the two arcuate portions of the outer periphery of the diaphragm, respectively, the center line of the each of the plurality of grooves is slanted by a first angle with respect to a tangent line to the inner periphery of the edge at a point where the centerline and the inner periphery intersects within the two semi-annular roll portions, the center line of the each of the plurality of grooves is slanted by a second angle with respect to the inner periphery of the edge within the two straight roll portions, and the first angle is smaller than the second angle.

11. The loudspeaker according to claim 9, wherein the outer periphery of the diaphragm has two straight portions having a linear shape and two arcuate portions having a semicircular shape, the edge includes two straight roll portions and two semi-annular roll portions, the two straight roll portions having a linear shape and being connected to the two straight portions of the diaphragm, respectively, the two semi-annular roll portions having a semi-circular shape and being connected to the two arcuate portions of the outer periphery of the diaphragm, respectively, intervals between the plurality of grooves within the two semi-annular roll portions of the edge are smaller than intervals between the plurality of grooves within the two straight roll portions of the edge.

* * * * *